United States Patent [19]

Oh

[11] Patent Number: 4,560,971

[45] Date of Patent: Dec. 24, 1985

[54] SPIRAL WOUND SHUNT TYPE SLOW BLOW FUSE

[75] Inventor: Seibang Oh, Elk Grove Village, Ill.

[73] Assignee: Littelfuse, Inc., Des Plaines, Ill.

[21] Appl. No.: 648,175

[22] Filed: Sep. 10, 1984

[51] Int. Cl.[4] ..... H01H 85/04

[52] U.S. Cl. ..... 337/164; 337/166; 337/293

[58] Field of Search ..... 337/164, 166, 163, 293, 337/161

[56] References Cited

U.S. PATENT DOCUMENTS 4,517,544 5/1985 Spaunhorst ..... 337/164

*Primary Examiner*—Harold Broome

*Attorney, Agent, or Firm*—Russell E. Hattis

[57] ABSTRACT

A slow blow fuse of the shunt type includes a pair of spaced terminals between which is connected and suspended a fuse wire assembly including a core of insulating material having at least a pair of fuse filaments upon the same, the outer of which is preferably an untinned spirally wound filament wrapped a number of times around one and more preferably at least two straight filaments, only one of which is tin plated, extending axially along the core. The uncoated spirally wound filament thus makes repeated physical and axial spaced electrical contact with the tinned filament. There are thus at least two fuse filaments in electrical parallel relation at a number of different locations therealong, each sharing a layer of tin coating. Each of the fuse filaments comprises a body of base metal which will melt instantly under short circuit current and is to melt under prolonged modest overload currents when the melting temperature lowering tinning material progressively migrates fully into the base metal body of the fuse filaments.

15 Claims, 6 Drawing Figures

SPIRAL WOUND SHUNT TYPE SLOW BLOW FUSE

DESCRIPTION

Technical Field of Invention

This invention relates to spiral wound, slow-blow fuses of the shunt type. U.S. Pat. Nos. 4,445,106 and 4,409,729 show examples of recently developed spiral wound fuses of a non-shunt type. The preferred form of the present invention is a fuse similar to that disclosed in these patents, except that it includes one and preferably at least two fuse filaments related in a unique manner in parallel with the single spiral wound filament disclosed in these patents.

BACKGROUND OF THE INVENTION

The spiral wound fuses disclosed in the above-identified patents have a cylindrical, transparent main body enclosed by cup-shaped terminal-forming metal end caps between which is soldered a fuse wire assembly extending tautly between the terminals. The fuse wire assembly includes a core made from a limp twisted bundle of ceramic yarn devoid of any sizing or the like. Fuse wire (sometimes referred to as a fuse filament) is spirally wound upon this limp bundle of twisted ceramic yarn to form a semi-rigid body which can maintain its position when soldered between the end caps described. The purpose of the insulating core is to act as a heat sink so that the fuse has slow blow characteristics under modest overload conditions.

Commonly, in slow blow fuses of the type just described the fuse wire comprises a tin plated copper wire. (Typically, the tin plating increases the thickness of the bare copper wire by a factor of about 1.16.) The tin plating material when it migrates into and alloys with the copper of the fuse wire, serves the function of increasing the resistance and reducing the melting temperature of the coated copper wire from that of the copper without the tin plating thereon. The tin plating material desirably remains as a coating on the base copper metal of the fuse wire until the coated wire is heated to a given high temperature by a given percent overload current flowing for a given minimum period of time. The tin then migrates at appreciable rates into the copper metal wire to form the copper-tin alloy which has a melting temperature much lower than the melting temperature of the pure copper. Thus, if this overload current persists for this period of time, the melting temperature of the copper alloy is reached and the fuse blows.

The migration rate of the tin plating can vary along different points of the tin plated copper wire, dependent upon the temperature at those points. Also, if there are imperfections like indentations at points in the copper wire, it will take a lesser time at a given temperature and amount of tin for the tin to migrate completely into the wire and produce a blown fuse wire. Such imperfections thus can undesirably cause a fuse to blow prematurely.

The most serious problem in slow blow fuses having tinned or similar coatings which alloy with the base metal to lower its melting temperature is that the migration of these coating materials is an irreversible process, and that it occurs, though more slowly under current flow conditions even below overload current, that is at rated current and below. Therefore, all slow blow fuses degrade with time. Thus, to maximize fuse life and to increase the margin of safety, fuse manufacturers commonly recommend that a fuse having a given rating be placed in circuits where normal current flow does not exceed 0.8 of its rating. The migration of the tin or other similar coatings occurs even at these lower current levels, so that the fuse still progressively degrades with use, whereby it undesirably blows at normal current levels if it is used long enough.

Still another problem which sometimes occurs due to the tin plating is that an undesirably thick coating of the tin plating can cause the tin plating to ball-up between turns of the spiral wound fuse wire and thereby short circuit the fuse wire before the blowing temperature is reached. In such case, the blowing conditions become modified which makes the fuse involved unreliable to perform its intended function.

It has been discovered that all of the above problems become exacerbated when two tin plated fuse wires are placed in intimate contact with one another, so that there are two thicknesses of tin plate between the copper wires. This occurs in a shunt fuse where the aforesaid tinned spiral fuse is wound over another similar tinned fuse wire to increase its current handling capacity.

In one commercial shunt fuse, the latter wire was a single straight tinned fuse wire extending axially along the insulating core of the fuse. Thus, each turn of the tinned spiral wound fuse wire crosses and contacts the straight fuse wire at spaced points therealong, to form a series of parallel connected fuse wire segments extending along the length of the fuse and separated by two layers of tin.

SUMMARY OF THE INVENTION

In such shunt fuses, the parallel connected fuse wires are usually designed to blow at about the same time, or in fast sequence where the blowing of one fuse wire results in a sudden increased heating of the other fuse wire as all of the current flows therein.

It is a feature of the present invention that the two crossing fuse wires of a shunt fuse share a common layer of tin of the same thickness as is normally applied to each of the fuse wires involved. It is preferred that only the shorter of the crossing fuse wire filaments be coated with tin for reasons to be explained. Under overload current conditions, the fuse wires become sufficiently heated that tin migrates at appreciable rates into both fuse wires to lower the melting temperature thereof.

While the broadest aspect of the invention envisions a shunt fuse wire assembly where an outermost tin plated spiral wound fuse wire is wound around one or more inner unplated straight or spiral wound fuse wires to form a shunt fuse, it is most preferred and a specific aspect of the invention that for the higher current rated fuses the outer spiral wound fuse wire be unplated and wound over at least one and preferably at least a pair of straight, axially extending fuse wires placed over the core, only one of which straight fuse wires is tin plated. The shorter of the crossing fuse wires is desirably the fuse wire coated with tin, since the total length of fuse wire coated with tin is thereby minimized. Also, it is then statistically less likely that a tin plated section of wire will create one or more of the problems described above. Also, since only the shorter crossing fuse wires are tin plated, the total cost of manufacture of the fuse is reduced. Low current rated fuses make desirable the coating of only the spirally wound fuse wire with tin for reasons to be explained.

Most importantly, I have discovered that the reliability of spiral wound slow blow fuses generally, that is even for fuse ratings where a fuse manufacturer would not normally use a shunt fuse, is markedly improved if a shunt fuse design as just described is utilized (provided the wires do not become unduly thin). Not only is reliability of the fuse increased thereby because the amount of tin coating present is reduced by coating only one straight fuse wire, thereby reducing the statistical possibility that premature blowing will occur for the reasons above described, but, more importantly, for an additional reason which is not readily apparent. Thus, because the resistance of a tin-coated fuse wire irreversibly progressively increases with time as tin migration occurs under all possible current conditions, the amount of current flowing in a coated wire shunted by a uncoated wire progressively decreases with time, as the uncoated fuse wire takes a progressively increasing percentage of the total current flow involved since there is a lesser or zero rate of tin migration occurring therein. The lesser current flow in the coated wire results in less heating thereof and therefore less migration of the tin into the coated fuse wire. There will be a lesser or zero rate of tin migration in the uncoated wire because, where one of the crossing fuse wires has a circular cross section, there will then be only a point or line contact in each intersecting region of the two wires. Therefore, the amount of tin migration is bound to be much greater in the coated fuse wire than the uncoated fuse wire, so that the increase of the resistance of the uncoated fuse wire with time is much less for the uncoated fuse wire. There is thus a shift of current flow from the coated to the uncoated fuse wire thereby reducing the tin migration rate in the coated wire and increasing the life of the fuse under normal load current conditions.

However, when current flow reaches the overload current value which is to cause blowing of the fuse, the coated wire becomes heated to such an extent that substantial migration of tin occurs in both fuse wires. When this overload current lasts for the period where blowing is desired, the hottest portion of the coated wire will usually blow first immediately following which the uncoated wire will blow as a greatly increased current flows therein.

The above and other features and advantages of the invention will be better understood upon making reference to the specification to follow, the drawings and the claims.

DESCRIPTION OF EXEMPLARY FORM OF THE INVENTION SHOWN IN THE DRAWINGS

Figure 1:
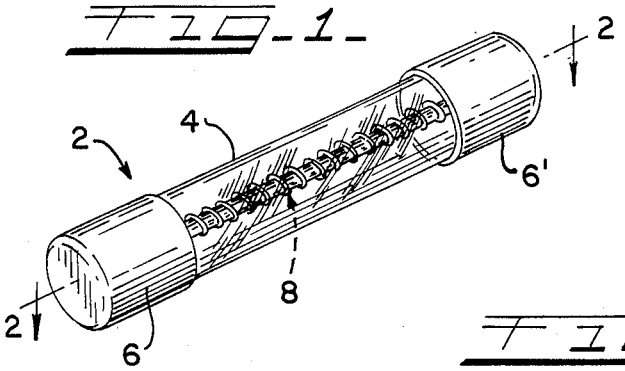
FIG. 1 is a perspective view of a slow blowing fuse made in accordance with the present invention.
Figure 2:
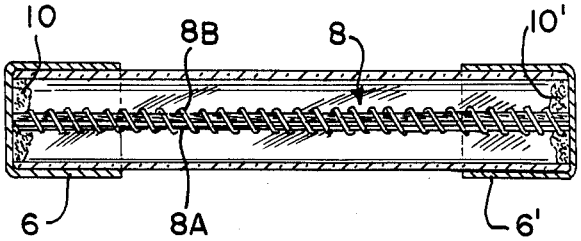
FIG. 2 is a longitudinal sectional view through the fuse shown in FIG. 1, taken along section line 2—2 therein.
Figure 3:
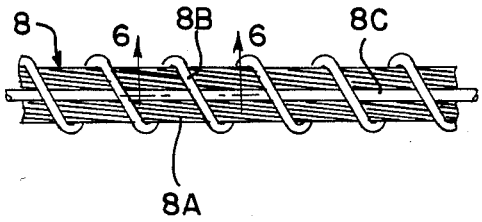
FIG. 3 is a greatly enlarged fragmentary elevational view of a portion of the fuse wire assembly shown in FIGS. 1 and 2.
Figure 5:
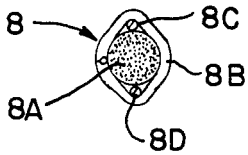
FIG. 5 is a vertical sectional view through FIG. 4, taken along section line 5—5 therein.

The slow blowing fuse illustrated in the drawings in FIGS. 1-4 and generally indicated by reference numeral 2 includes a main cylindrical casing 4 of a suitable insulating material, like glass or a ceramic material, closed by conductive end caps 6-6'. A spiral wound fuse assembly 8 is in electrical contact with and extends between the end caps 6-6' where the fuse wire portion of the body 8 is intimately anchored and electrically connected to these end caps by solder 10-10'.

The fuse assembly comprises preferably a core of limp dead yarn 8A made of twisted filaments or strands of an electrical insulating, heat-sinking material, preferably a ceramic material like that manufactured by the 3M Company and identified as the Nextel 312 ceramic fiber, processed in a unique way to be described, so that the core 8A is substantially devoid of any sizing or other binding material which will carbonize when subjected to the conditions of a blowing fuse. A fuse wire winding 8B of circular cross-section is wound around the ceramic yarn core 8A. The fuse wire is most advantageously an uncoated body of copper or other material which melts instantly under short circuit conditions and under prolonged modest overload conditions when tin material to be described migrates therethrough.

Figure 6:
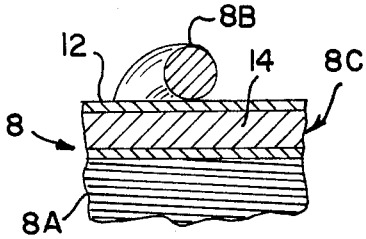
FIG. 6 is an enlarged longitudinal sectional view of FIG. 3, taken along section line 6—6 therein.
Figure 4:
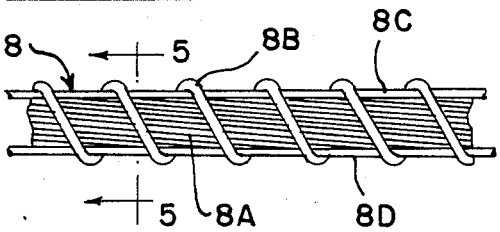
FIG. 4 is a view like that shown in FIG. 3 but as seen at right angles thereto.

In the most perferred form of the invention now being described, a tin-coated copper wire 8C of circular cross-section and an unplated copper wire 8D of circular cross-section are positioned preferably on opposite diametrical sides of the core 8A of limp yarn before the fuse wire winding 8B is applied tightly therearound, so that there is intimate contact between the fuse wire winding 8B and the fuse wires 8C and 8D. The fuse wires 8C and 8D could be either spiral wound with a longer pitch around different points of the core 8A or more preferably extend in straight lines axially along the core 8A. Since one of fuse wire 8C is plated with tin there is a common layer of tin plating shared between it and the crossing fuse wire 8B at its points of contact therewith. This sharing of a common layer of tin is best shown in FIG. 6 where the tin coating 12 on the copper core 14 of straight fuse wire 8C is contacted and shared by the unplated outer spiral wound fuse wire 8B. Note, however that because the cross-sectional shapes of the fuse wires 8B and 8C is circular, their areas of contact are very small points of contact.

An exemplary fuse designed to meet the UL-198G specifications may have the following parameters:

FUSE (Overall Dimensions and Ratings): $\frac{1}{4}$"dia.$\times 1\frac{1}{4}$" long, 15A, 125V Fuse wires: 8B—0.0113 dia. unplated copper wire; 23 turns per inch; 8C=0.0096" dia. copper wire, pure tin plated 0.0008" thick; 8D=0.0073" dia. unplated copper wire.

Core—0.032" diameter of 3M 312 NEXTEL (trademark) ceramic fiber yarn comprising 4 strands of ceramic filaments twisted as disclosed in U.S. Pat. No. 4,409,729, each strand comprising 390 filaments;

Housing—1.2" long. glass cylinder 0.027" thick wall and 0.166" inner diameter

Time Current Characteristics (typical): $1.1\times$rated current $I_n$—does not blow $1.35\times I_n$—blows at 15 min. $5\times I_n$—blows at 560 milliseconds As previously indicated, the migration of tin into the body of the fuse wire increases the resistance thereof in an irreversible manner. It should be apparent that fuse life is increased as this migration and change in fuse wire resistance is minimized at rated current and below. It should thus be apparent that where two crossing fuse wires are connected in parallel at various points as described and both have a tin coating which migrates in both wires at a similar rate, a similar change in resistance occurs in both fuse wires and so there is no appreciable current shifting with time which can reduce the migration rate as in the present invention. Thus, when only one of the crossing fuse wires has a tin coating, under rated current and below this coating does not migrate at all or substantially into the uncoated wire. Consequently, as the resistance of the coated wire progressively increases with time, the percentage of the current carried thereby decreases to reduce the tin migration rate and increase the life of the fuse.

In the exemplary fuse just described, initially before any migration of tin into the fuse wire 8C takes place, approximately 52.5% of the current flows through the straight fuse wire 8C, 17.7% of the current flows through the spiral wound fuse wire 8B and 29.8% of the current flows through the unplated straight fuse wire 8D. Theoretically, a slow blow fuse desirably has a maximum overall volume of core and winding material for a given current rating. Assuming the cross section and value of the core material is a fixed parameter, it would be most desirable theoretically that the winding having the longest length, namely the spiral winding 8B have the largest cross sectional area. However, when the longest wire is unplated, as in the case of the preferred form of the invention, the tin coating on the coated fuse wire 8C must have a sufficiently large thickness to be able to supply adequate amounts of tin for both wires 8B and 8C. Using commercially available tin plating equipment, it was found desirable to fix the ratio of the diameter of the plated copper wire to its unplated diameter for all fuse wire sizes. In the commercial tin plating equipment used by the assignee of the present application, this ratio was found to be most desirable at 1.163. With this limitation, the diameter of the spiral wound fuse wire 8B was limited by the tin coating thickness used on the straight fuse wire 8C. Accordingly, it was found desirable for a 15 amp fuse that the diameters of the coated and uncoated fuse wires 8B and 8C as indicated above be of similar magnitude, even though it is theoretically desirable to use a spiral wound fuse wire of much greater size than that of the straight fuse wire 8C.

However, the ratio of diameters of the uncoated and coated fuse wires increased to a value substantially in excess of one for lower rated fuses.

For lower rated fuses, such as fuses having ratings of about 3 amps and below, the desirable slow blow characteristics of the fuse which requires a maximum volume of core and filament wire material creates a problem which makes desirable the tin plating of the spiral wound fuse winding 8B rather than the straight fuse wire 8C. That is to say that since the volume of the fuse wire at low current ratings where the diameter of the fuse wires becomes a minimum, to provide a desirable large volume of fuse wire it was found most desirable to tin plate the spiral wound fuse winding 8B, even though this increased the cost of the fuse somewhat, for reasons previously explained.

Differently rated fuses are achieved by varying the diameter or composition of the fuse wires, the thickness of the tin coating and the heat sinking characteristics of the core, and by the number of straight fuse wires used.

While the core 8A could be made of a variety of different materials and ways and sizes, it is preferably disclosed in said U.S. Pat. No. 4,409,729.

It should be understood that numerous modifications may be made in the most preferred form of the invention just described without deviating from the broader aspects of the invention, although the details thereof are important specific aspects of the invention. Thus, for higher current ratings, other fuse wires like 8C or 8D may be added to the core 8A to increase the current rating of the fuse or for other reasons.

It should also be understood that while in the most preferred form of the invention only one of a pair of crossing fuse wires forming the shunt fuse is coated with tin, the present invention would not be circumvented if one were to coat the other fuse wire with such a thin layer of tin as to have little or no effect on the blowing characteristics of the fuse. Thus, to eliminate the possibility of infringement avoidance in such case, the claims refer to only one of the crossing fuse wires having an "active" layer of tin, meaning a layer of tin or other similar material of sufficient thickness to cause sufficient tin migration significantly to affect the blowing characteristics of the fuse.

I claim:

1. In a slow blow fuse which includes a pair of spaced terminals between which is connected and suspended a fuse wire assembly, said fuse wire assembly including a core of insulating material having a spirally wound fuse filament wrapped a number of times around said core, the improvement comprising a second fuse filament on said core unit wherein said spirally wound fuse filament makes repeated axially spaced physical and electrical contact with said second fuse filament, so that at least two fuse filaments cross and are in electrical parallel circuit connection and cross at a number of different locations therealong, each fuse filament comprising a body of base metal which will melt instantly under short circuit current and is to melt under prolonged overload currents at least when a melting temperature lowering tinning material or the like initially on the outside thereof has progressively migrated to an effective degree into the base metal body of said fuse filaments, and there being only a single active layer of said tinning material or the like contacting the outer margins of the base metal of said fuse filaments along the length thereof where it can migrate into both of the same, so that said single layer of tinning material or the like is shared at said contact locations where the tin can migrate into both fuse filaments at these points under overload current conditions.

2. The slow blow fuse of claim 1 wherein said shared active layer of tinning material or the like is a pre-applied coating on only one of said fuse filaments contacting at said points.

3. The slow blow fuse of claim 2 wherein one of said fuse filaments contacting at said points is much shorter than the other, and said pre-applied coating of tinning material is on only the shorter of the fuse filaments contacting at said points.

4. The slow blow fuse of claim 3 wherein said tinning material or the like also migrates at least into the fuse filament on which it is coated at currents below said overload current progressively to increase the resistance thereof, the locations of contact of the uncoated fuse wire with the coated one being such that migration of said tinning material or the like into the uncoated fuse filament is nonexistent or much less than that occurring in said coated fuse filament below said overload current.

5. The slow blow fuse of claim 4 wherein at least one of the crossing fuse filaments is curved so that it makes only repeated points of contact with the other fuse filament, which points of contact hinder and thus reduce the migration rate of the tinning material and the like thereat in comparison to that in the coated wire.

6. The slow blow fuse of claim 3 wherein said coated shared active layer of tinning material or the like migrates much more quickly, if at all, into the fuse filament on which it is coated, than it does in the other of same at currents below said prolonged overload currents flowing through the fuse, and said coated wire blowing first under said prolonged overload current, to shift at least part of the current therein to the other fuse filament contacted thereby, which then blows under the increased current flow therethrough.

7. The slow blow fuse of claim 1 or 2 wherein the longer of said fuse filaments is wrapped around the shorter of said fuse filaments.

8. The slow blow fuse of claim 1 or 3 wherein the shorter of said fuse filaments is a substantially straight fuse filament extending axially along said core.

9. The slow blow fuse of claim 3 wherein the shorter of said fuse filaments is a substantially straight fuse filament extending axially along said core and is enveloped by said spirally wound filament.

10. The slow blow fuse of claim 1 wherein there are at least three of said fuse filaments on said core connected in parallel, two of which are circumferentially spaced and substantially straight fuse filaments extending axially along said core and engaged by said spirally wound fuse filament, and only one of the fuse filaments engaged by said spirally wound fuse filament has an active coating of tinning material.

11. The slow blow fuse of claim 1, 2 or 3 wherein there are at least three of said fuse filaments on said core, two of which are circumferentially spaced substantially straight fuse filaments extending axially along said core and enveloped by said spirally wound fuse filament.

12. The slow blow fuse of claim 1, 2 or 3 wherein there are at least three of said fuse filaments on said core, two of which are circumferentially spaced, substantially straight fuse filaments extending axially along said core on opposite diametrical sides thereof, and contactingly surrounded by said spirally wound fuse filament wound therearound.

13. The slow blow fuse of claim 3 contactingly enveloped by said spirally wound fuse filament so that the latter fuse filament contactingly crosses each of the other fuse filaments at a number of points therealong and only one of the fuse filaments overlapped by said spirally wound fuse filament has an active coating of tinning material.

14. In a slow blow fuse which includes a pair of spaced terminals between which is connected and suspended a fuse wire assembly, said fuse wire assembly including a core of insulating material having a fuse spirally wound filament wrapped a number of times around said core, the improvement comprising a second fuse filament on said core wherein said spirally wound fuse filament makes repeated axially spaced physical and electrical contact with said second fuse filament, so that at least two fuse filaments cross and are in electrical parallel circuit connection and cross at a number of different locations therealong, each of said fuse filaments comprising a body of base metal which will melt instantly under short circuit current and is to melt under prolonged overload currents at least when a melting temperature lowering tinning material or the like initially on the outside thereof has progressively migrated to an effective degree into the base metal body thereof, and only one of the crossing fuse filaments having a coating therein of an active layer of said tinning material or the like which can readily migrate into the same, the latter fuse filament blowing first under said prolonged overload current to shift at least part of the current therein to the fuse filament contacted thereby, which then blows under the increased current flow therethrough.

15. The slow blow fuse of claim 14 wherein at least one of the crossing fuse filaments is curved so that it makes only repeated points of contact with the other fuse filament, which points of contact hinder and thus reduce the migration rate of the tinning material and the like thereat in comparison to that in the coated wire.

* * * * *